United States Patent [19]

Hoffman et al.

[11] 4,300,847

[45] Nov. 17, 1981

[54] TELEPRINTER HAVING SINGLE BELT CARRIAGE AND RIBBON DRIVE SYSTEM

[75] Inventors: Robert C. Hoffman, Park Ridge; Richard H. Kruse, Deerfield; Donald P. Martin, Wheeling, all of Ill.

[73] Assignee: Qwint Systems, Inc., Northbrook, Ill.

[21] Appl. No.: 38,942

[22] Filed: May 14, 1979

[51] Int. Cl.[3] ..... B41J 33/10

[52] U.S. Cl. ..... 400/196.1; 400/229; 400/233; 400/235.1; 400/320; 400/59; 400/902; 400/903

[58] Field of Search ..... 400/59, 194, 195, 196, 400/196.1, 208, 229, 233, 235.1, 320, 338.2, 902, 903

[56] References Cited

U.S. PATENT DOCUMENTS

| | | | |
|---|---|---|---|
| 3,283,876 | 11/1966 | Kern | 400/194 |
| 3,401,783 | 9/1968 | Norwood et al. | 400/229 X |
| 3,578,012 | 9/1973 | Bonner et al. | 400/235.1 X |
| 3,670,861 | 6/1972 | Zenner et al. | 400/338.2 X |
| 3,726,381 | 4/1973 | Murphy | 400/208 X |
| 3,841,459 | 10/1974 | Buschmann et al. | 400/229 X |
| 3,904,018 | 9/1975 | Denley | 400/196 |
| 3,939,957 | 2/1976 | Bittner | 400/229 X |
| 3,949,857 | 4/1976 | Peters et al. | 400/320 X |
| 3,960,256 | 6/1976 | Bickoff et al. | 400/320 X |
| 4,044,883 | 8/1977 | Boehmer | 400/320 X |
| 4,086,997 | 5/1978 | Wu | 400/59 X |

FOREIGN PATENT DOCUMENTS 2758790 7/1978 Fed. Rep. of Germany ... 400/196.1

OTHER PUBLICATIONS

IBM Technical Disclosure Bulletin, "Gear Drive Ribbon Reversing Mechanism", Nolden et al., vol. 20, No. 2, Jul. 1977, pp. 728–729.

*Primary Examiner*—Ernest T. Wright, Jr.
*Attorney, Agent, or Firm*—Lockwood, Dewey, Alex & Cummings

[57] ABSTRACT

A teleprinter includes a carriage for conveying a dot matrix-type print head along an operating path parallel to a print-receiving surface. The carriage is mounted on parallel-spaced support rods by means of spaced bearings slidably engaged to one of the support rods, and a pair of perpendicularly-aligned guide rollers which engage the other guide rod. The carriage is advanced by a drive belt which extends along the carriage operating path and is attached to the carriage at either end. A stepper motor coupled to one of the pulleys drives the belt to position the carriage. A removable cartridge on the carriage contains an inked ribbon which is advanced with movement of the carriage by a drive gear engaged to the drive belt. A unidirectional clutch prevents the inked ribbon from moving in a reverse direction during carriage return.

12 Claims, 8 Drawing Figures

3.
3.
13
14
16
17
24
25
26
27
31
32
33
34
35
40
41
42
43
44
45
46
47
48
49a
49b
50
51
52
53
54
55
56
57
60
66
77
82
83
84
85
86
90
91
92
93
99

FIG. 3
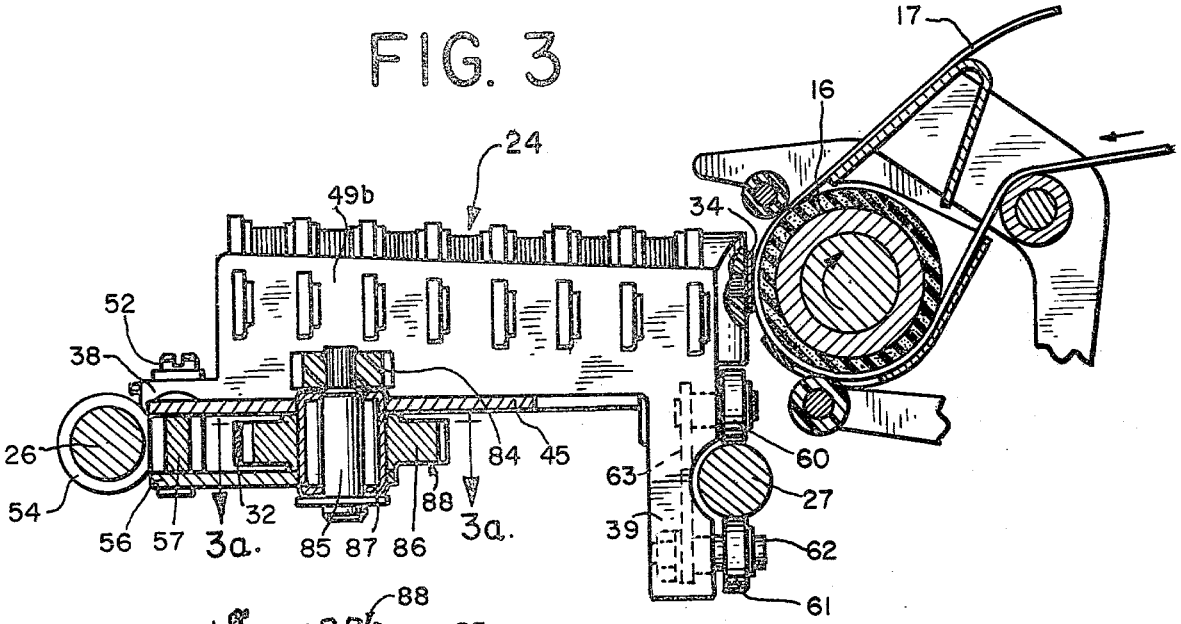
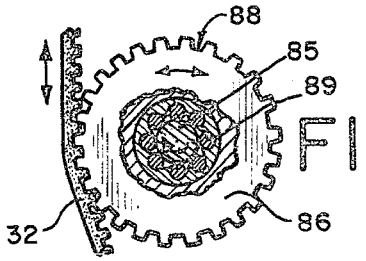
FIG. 3a
FIG. 6
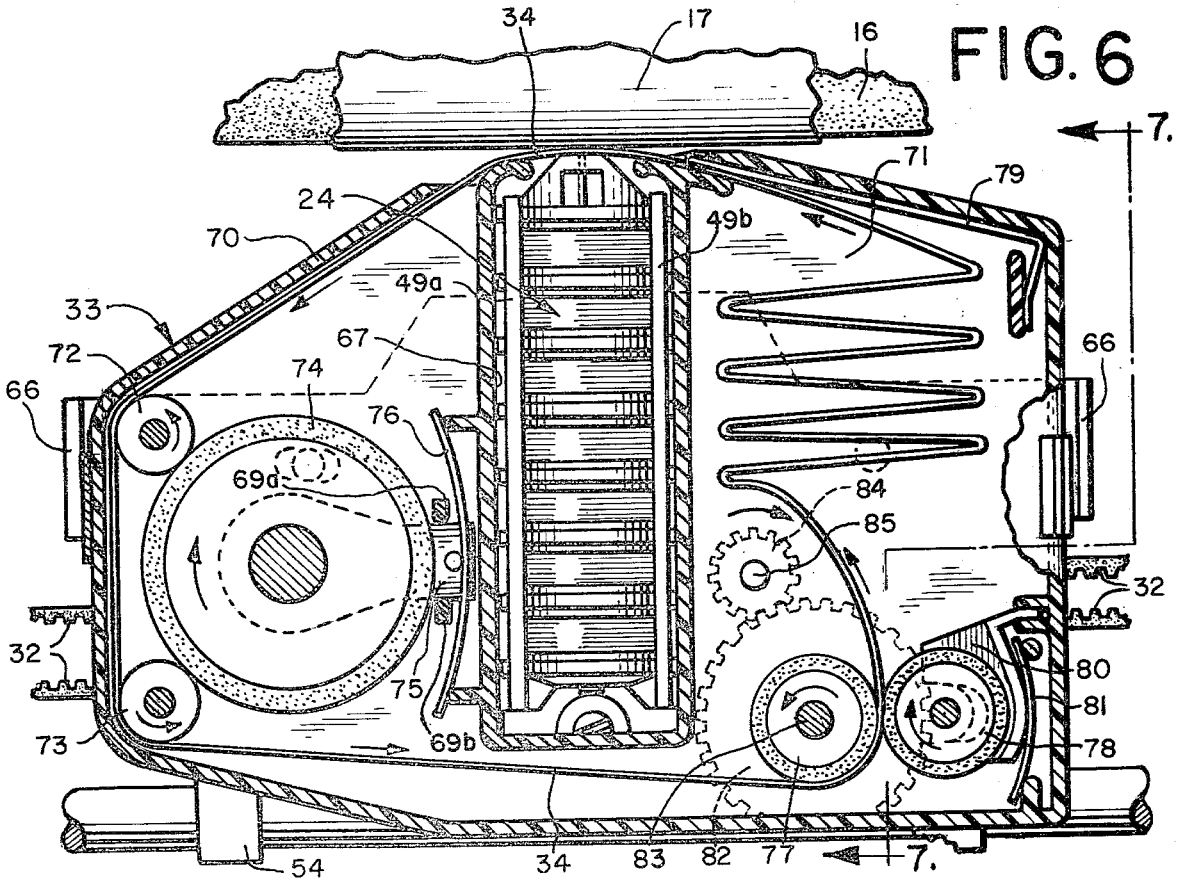

TELEPRINTER HAVING SINGLE BELT CARRIAGE AND RIBBON DRIVE SYSTEM

BACKGROUND OF THE INVENTION

The present invention is directed generally to data terminals, and more particularly to a teleprinter incorporating an improved print head carriage and removable ink ribbon cartridge.

In recent years the increased use of data-based communication systems has led to the need for economical high speed data terminals whereby information conveyed by electrical signals is converted to printed copy on paper or other suitable print-retaining surface. Typically, such teleprinters incorporate an impact-type print head, which impacts the paper against a platen as the print head moves across the paper, causing impressions to be made on the paper by an inked ribbon or by chemical transformation of the paper. One particularly successful form of impact-type print head is the dot matrix-type print head, wherein selected ones of a plurality of elongated rod-shaped print wires arranged in a predetermined array are forced against the paper to form the desired characters as the print head is stepped across the page. A preferred colinear construction for such a print head is shown in the copending application of Robert C. Hoffman, Richard H. Kruse, and Donald P. Martin, Ser. No. 038,923, filed concurrently herewith and assigned to the present assignee.

In order for a teleprinter to be suitable for use in a large number of applications, it is desirable that the teleprinter be economical, compact and reliable in construction. To this end, it is desirable that the carriage mechanism provided in the teleprinter for positioning the print head be constructed with as few components as possible, and that the components utilized be arranged in a compact manner to allow the smallest possible housing. Furthermore, for sharp consistent print images it is necessary that the print head be accurately and reliably positioned by the carriage, not only during the printing of each line, but also during carriage return and line feed operations. Heretofore, print head carriage arrangements for positioning the print head with the necessary precision have been unnecessarily complex, and have therefore unnecessarily added to the cost of teleprinters. Representative prior art print head carriage arrangements are described in U.S. Pat. Nos. 3,960,256, 3,949,857 and 3,670,861.

With impact printers it is conventional practice to place an inked ribbon between the print elements of the print head and the paper to form a visible impression on the paper at each impact location. Typically, this inked ribbon is contained on two spools, at least one of which is periodically driven with movement of the print head to cause the ribbon to be advanced from one spool to the other, thereby exposing the paper to a continuously changing unused portion of the ribbon to provide a consistently legible print image. Heretofore the mechanisms for advancing teleprinter print head ribbons have been relatively complex, and have unnecessarily added to the cost of the teleprinter and to the time and expense of periodic maintenance. Furthermore, the complexity of the prior-art ribbon drive arrangements has heretofore precluded the use in teleprinters of pre-loaded ribbon cartridges, wherein the inked ribbon can be conveniently changed by merely substituting one cartridge for another, without the necessity of threading the ribbon between spools or ribbon guards, or physically handling the ribbon.

The present invention is directed to a new and improved print head carriage, and to a new and improved removable inked ribbon cartridge for the carriage, which provide improved economy, reliability and convenience of operation in an impact-type teleprinter.

Accordingly, it is a general object of the present invention to provide a new and improved teleprinter which is economical, reliable and compact in construction.

It is a more specific object of the present invention to provide a new and improved print head carriage assembly for a teleprinter which is compact, reliable and economical in construction.

It is another specific object of the present invention to provide a new and improved print head carriage assembly for a teleprinter wherein the inked ribbon associated with the carriage is contained in a readily removable cartridge.

It is another specific object of the present invention to provide a new and improved print head carriage assembly wherein the inked ribbon carried thereon is automatically advanced with movement of the carriage.

It is another general object of the present invention to provide a new and improved removable inked ribbon cartridge for a teleprinter.

Summary of the Invention

The invention is directed to a teleprinter including a head assembly responsive to an applied signal for printing characters on a print-receiving surface. The teleprinter comprises means including a carriage slidably mounted on first and second support shafts fixedly positioned parallel to the print-receiving surface for supporting the print head in generally perpendicular alignment to the print-receiving surface. Means including first and second bearings attached to one side of the carriage on respective sides of the print head and slidably engaged on the first support shaft, and first and second support rollers aligned generally perpendicular to the bearings and engaged with opposite sides of the second support shaft, are provided to support the carriage for movement parallel to the print-receiving surface.

The invention is further directed to a teleprinter which includes a print head responsive to an applied information signal for printing data on a print-receiving surface, and a carriage for moving the print head across the surface in generally perpendicular alignment to the print-receiving surface. Drive means comprising first and second pulleys at either end of the carriage operating path, and a flexible belt extending between the pulleys and into engagement with the carriage assembly along one span thereof, move the carriage along the operating path in response to a received data signal. Means including an ink ribbon carried on the carriage and positioned between the print head and the print-receiving surface are provided for producing an image on the print-receiving surface upon impact of print elements in the print head, the ribbon requiring periodic advancement upon actuation of the print elements to avoid depletion of the ink contained thereon. Ribbon drive means mechanically coupled to the other span of the drive belt are provided for advancing the ink ribbon during movement of the print head.

BRIEF DESCRIPTION OF THE DRAWING

The features of the present invention which are believed to be novel are set forth with particularity in the appended claims. The invention, together with the further objects and advantages thereof, may best be understood by reference to the following description taken in conjunction with the accompanying drawing, in the several figures of which like reference numerals identify like elements, and in which:

FIG. 3 is a cross-sectional view taken along line 3—3 of FIG. 2 illustrating the mounting arrangement for the print head carriage.

FIG. 3*a* is a cross-sectional view taken along line 3*a*—3*a* of FIG. 3 showing the unidirectional clutch utilized on the print head carriage for advancing the ink ribbon.

FIG. 6 is an enlarged cross-sectional view of the ink ribbon cartridge taken along line 6—6 of FIG. 5.

DESCRIPTION OF THE PREFERRED EMBODIMENT

Figure 1:
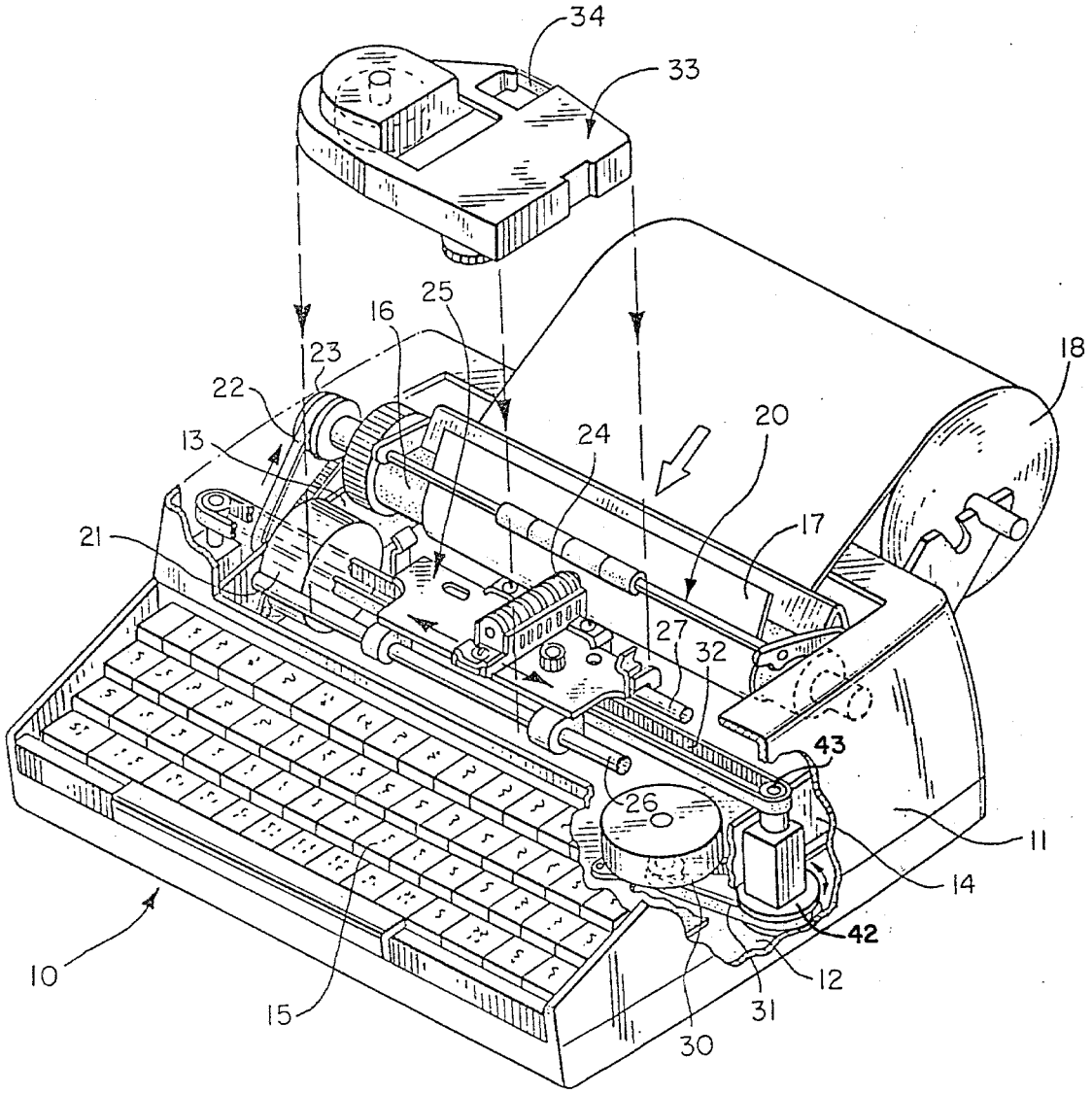
FIG. 1 is a perspective view of a teleprinter incorporating a print head carriage and ink ribbon cartridge constructed in accordance with the present invention.

Referring to the figures, and particularly to FIG. 1, a high speed teleprinter 10 constructed in accordance with the present invention is seen to include a housing 11 within which a frame comprising a base plate 12 and side plates 13 and 14 are contained. A keyboard 15 of conventional construction is incorporated into the front portion of the housing 11, and a platen 16 extending across the rear portion between side plates 13 and 14 serves to position a sheet of paper 17, either in web form from a roll 18, as shown, or in folded form, in position for printing. A conventional guide bar 20 is biased against the front surface of the paper 17 to hold the paper 17 in position on platen 16.

Paper 17 is advanced on platen 16 by means of a first stepper motor 21 rotatably coupled to the platen 16 by means of a cogged drive belt 22 and pulley 23. Visible characters are produced on paper 17 by means of a dot matrix-type print head 24. The print head 24 is mounted on a print head carriage assembly 25, which is mounted for lateral movement across the paper 17 by means of parallel-spaced guide rods 26 and 27 which extend between side plates 13 and 14. A second stepper motor 30, mounted on base plate 12 and coupled to carriage assembly 25 by means of cogged drive belts 31 and 32, is provided for advancing the carriage assembly 25, and hence print head 24, across the paper 17. A removable ribbon cartridge 33 carried on the print head carriage assembly 25 includes an ink ribbon 34 which is positioned between the print elements 29 of print head 24 and paper 17 to render each impact of the print elements 29 of the print head 24 visible on the paper 17.

Print head 24, which is preferably constructed in accordance with the previously identified copending application, Ser. No. 038,923, includes a plurality of vertically-aligned print elements 29 (FIG. 4) in the form of wires which are selectively energized to impact against paper 17 as the print head carriage assembly 25 is moved left-to-right across the paper 17 to form the desired characters. Upon completion of each horizontal line, the paper 17 is advanced vertically by one line and the print head 24 is returned to the left margin of the printed page, so that the subsequent line will be printed immediately beneath the previously printed line.

Figures 2, 7:
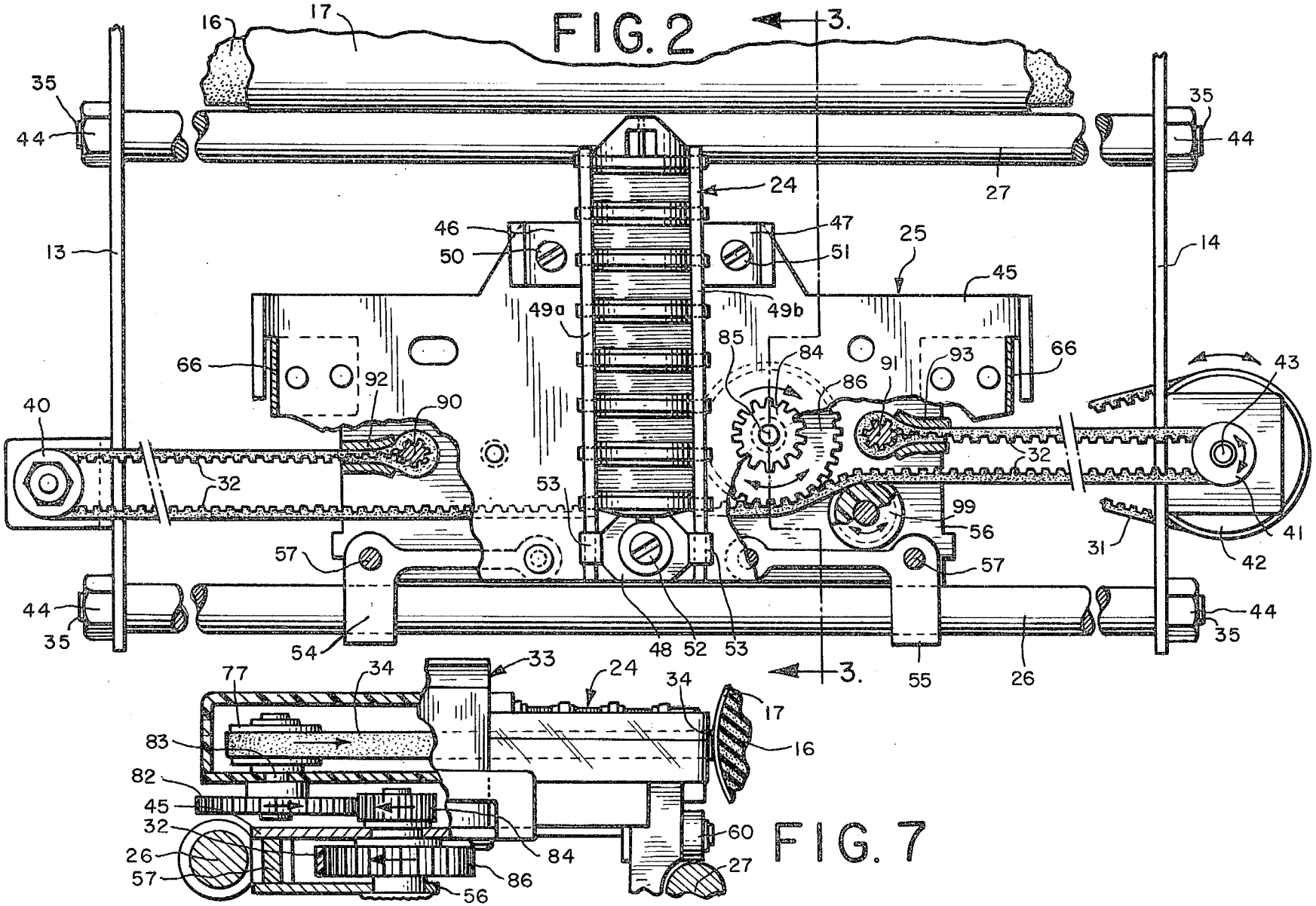
FIG. 2 is an enlarged top plan view of the print head carriage partially broken away to show the carriage and ink ribbon drive arrangements of the teleprinter.
FIG. 7 is a cross-sectional view taken along line 7—7 of FIG. 6 showing the drive arrangement utilized for advancing the ink ribbon contained in the removable ribbon cartridge.

Referring to FIG. 2, print head carriage assembly 25 is advanced across the paper 17 by means of the cogged drive belt 32 which extends between a pair of pulleys 40 and 41 rotatably mounted on respective side plates 13 and 14. Between the two pulleys 40 and 41, the belt span nearest platen 16 is fixedly secured to carriage assembly 25, and the remaining belt span is not so secured. As a result, upon rotation of either pulley 40 or 41, the carriage assembly 25 is caused to move along the operating path defined by guide rods 26 and 27. For clockwise rotation (as viewed in FIG. 2) of pulley 41 the carriage assembly 25 is driven to the right, thereby advancing across the paper 17. For counterclockwise rotation, the carriage assembly 25 is driven to the left. In operation, pulley 41 is rotatably driven by means of stepper motor 30 (FIG. 1), which is coupled to pulley 41 by means of the cogged drive belt 31 which engages a pulley 42 carried on a common drive shaft 43 with pulley 41.

In operation, carriage assembly 25, and hence print head 24, are driven from left to right by stepper motor 30 as each line is printed, individual print elements 29 of the print head 24 being selectively energized during the horizontal movement to print desired characters on the paper 17. Upon completion of each line, stepper motor 30 is reversed and functions to rapidly drive the print head 24 back to the left hand margin of the paper 17. At the same time, stepper motor 21 is energized to advance paper 17 such that the line next to be printed is brought into registration with the print head 24.

Referring again to FIG. 2, the print head carriage guide rods 26 and 27 are mounted in a parallel-spaced relationship between side plates 13 and 14 and are attached to the side plates 13 and 14 by means of threaded stud portions 35 which receive respective hex nuts 44. The print head carriage assembly 25 includes a generally rectangular base plate 45 to which the print head 24 is mounted by means of brackets 46–48 arranged along the left side, right side and rear end of the print head 24. The brackets 46–48 are attached to the base plate 45 by means of respective machine screws 50, 51 and 52. The mounting brackets 46 and 47 each include a projecting tab portion 36 which engages a complimentarily dimensioned slot 37 in the print head 24 to secure the print head 24 in position. Mounting bracket 48 includes two oppositely projecting tab portions 53 which engage rearwardly extending extensions 38 of the print head side plates 49*a* and 49*b* to secure the rear end of the print head 24 in position. To adjust the position of the print head 24, it is only necessary to loosen screws 50–52, thereby allowing the print head 24 to be moved in either direction until the desired position is obtained.

The print head carriage assembly 25 is slidably mounted on the rear guide rod 26 by means of a pair of annular collar-like bearings 54 and 55. These bearings 54 and 55 are positioned at opposite ends of the rear edge of the base plate 45 opposite platen 16 and are dimensioned to provide a precision but freely sliding engagement with the guide rod 26. A second base plate 56 is mounted beneath and parallel-spaced from base plate 45 by means of a plurality of rivets 57 or other appropriate fastening means extending between the two base plates 45 and 56.

Figure 4:
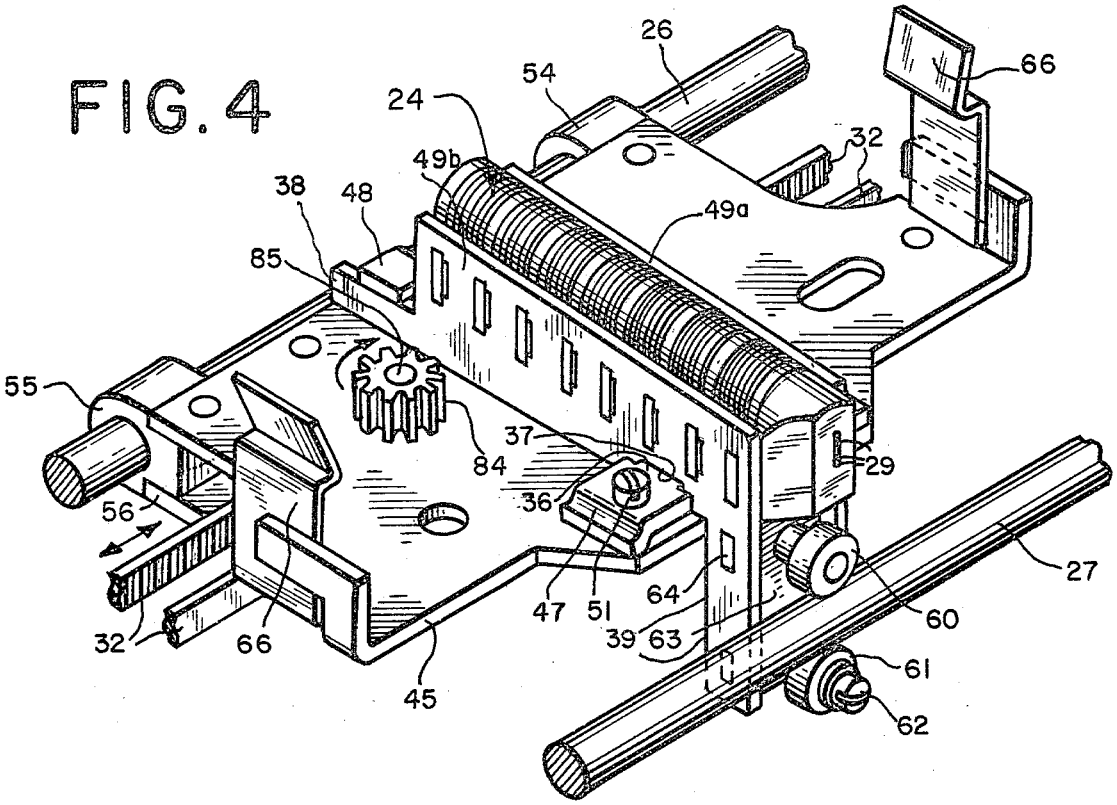
FIG. 4 is an enlarged perspective view of the print head carriage shown in FIG. 2 with the ink ribbon cartridge removed.
Figure 5:
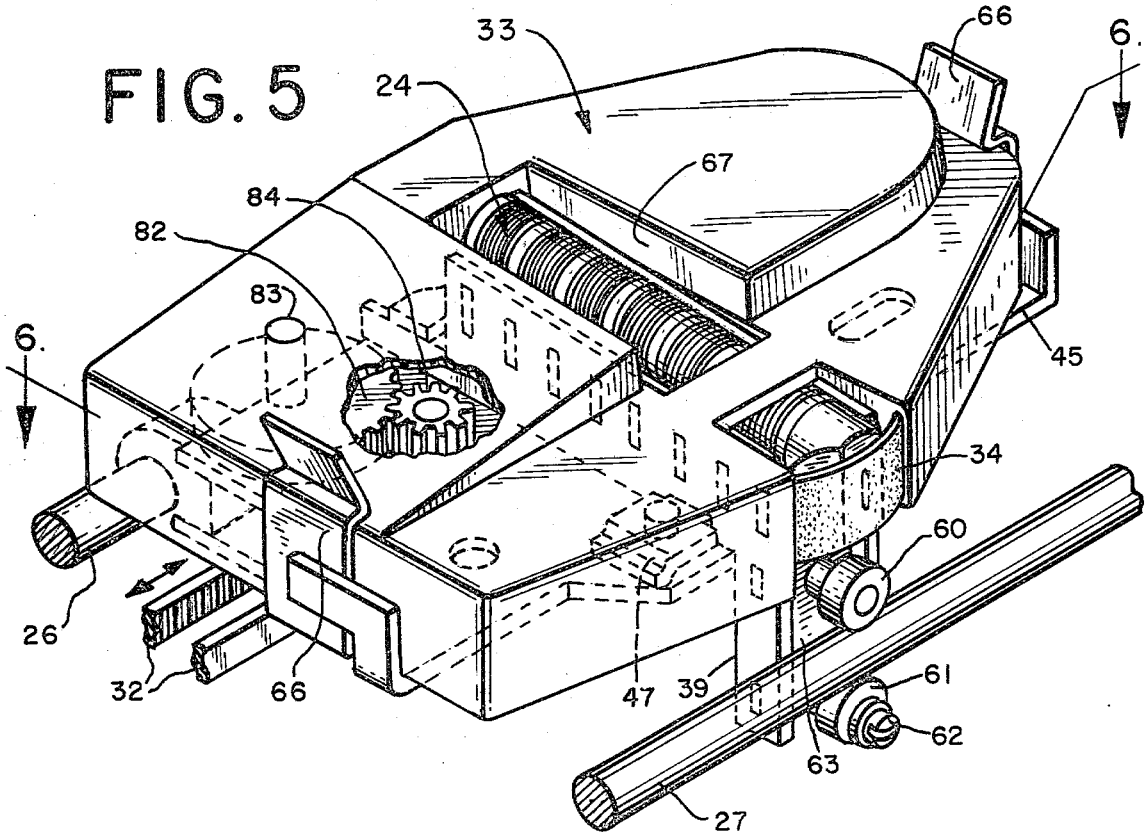
FIG. 5 is an enlarged perspective view of the print head carriage similar to FIG. 4 with the ink ribbon cartridge installed.

Referring to FIGS. 4 and 5, the print head carriage assembly 25 is slidably mounted on the front guide rod 27 by means of a pair of vertically spaced guide rollers 60 and 61 positioned above and below the guide rod 27. The bottom guide roller 61 is preferably mounted on an eccentric pivot screw 62 so that the exact vertical spacing between the guide rollers 60 and 61, and hence the clearance for guide rod 27, can be precisely set. Rollers 60 and 61 are mounted on a transverse plate member 63 mounted by means of tab portions 64 which engage complimentarily dimensioned slots in downwardly-projecting portions 39 of the print head side plates 49*a* and 49*b*. Guide members 54, 55, 60 and 61 together form a stable three-point suspension for the carriage assembly 25.

When the removable ink ribbon cartridge 33 is in position on carriage assembly 25 the ink ribbon 34 contained therein is positioned between print head 24 and paper 17. The cartridge 33 is secured by means of a pair of spring clips 66 arranged at opposite ends of base plate 45. When the cartridge 33 is seated on the base plate 45, these spring clips 66 engage the upper rim of the cartridge 33 to hold the cartridge 33 securely in position. As best seen in FIG. 5, the cartridge 33 includes a channel 67 within which the print head 24 is received when the cartridge 33 is in position.

Referring to FIG. 6, the removable cartridge 33 is seen to comprise a generally rectangular plastic housing 70 forming an interior compartment 71 within which a continuous length of inked cloth ribbon 34 is contained. The ribbon 34 extends across channel 67 along the periphery of housing 70 and into contact with a pair of ink transfer rollers 72 and 73. These rollers 72 and 73 are arranged to rotate in contact with an ink roller 74 contained within the housing 70. Ink roller 74 is rotatably mounted on a support member 75 which is slidably mounted on housing 70 between guide members 69*a* and 69*b* spring-biased by a spring strip 76 so as to press roller 74 into contact with rollers 72 and 73. In operation, as ribbon 34 is drawn across transfer rollers 72 and 73, ink roller 74 is caused to turn by the rotation of transfer rollers 72 and 73 so that ink contained on the ink roller 74 is transferred to the transfer rollers, 72 and 73, and then to the ribbon 34.

From ink transfer roller 73 ribbon 34 extends along the periphery of housing 70 to a drive roller 77. The ribbon 34 is compressed against drive roller 77 by a compression roller 78 mounted on a slidable support member 80 within housing 70. Support member 80 is biased by a spring strip 81 to force compression roller 78 into contact with roller 77. From drive roller 77 the inked ribbon 34 is routed to a stuffing area wherein it is folded back many times prior to being routed across channel 67. A spring strip 79 maintains ink ribbon 34 in tension as it is drawn across the front of print head 24.

In operation, ribbon drive roller 77 is rotatably driven by means of a gear 82 mounted on the exterior of housing 70. Gear 82 and drive roller 77 are carried on a common shaft 83 which extends through the housing 70. When cartridge 33 is seated on carriage assembly 25 gear 82 is brought into engagement with a ribbon drive gear 84 mounted on the carriage assembly 25. As shown in FIG. 3, the ribbon drive gear 84 is mounted on a shaft 85 which extends through the parallel-spaced base plates 45 and 56. A ribbon drive pulley 86 is mounted on shaft 85 and rotatably coupled thereto by means of a unidirectional clutch assembly 88. A C-washer 87 or other appropriate keeper means is provided for securing drive shaft 85 in position.

In accordance with the invention, drive pulley 86, as shown in FIG. 2, is engaged with carriage drive belt 32 along its uninterrupted span between pulleys 40 and 41 so that upon advancement of the carriage assembly 25 drive pulley 86 is rotatably driven. An idler pulley 99 (FIG. 2) mounted for free rotation on carriage assembly 25 between base plates 45 and 56 deflects belt 32 into engagement with pulley 86. As shown in FIG. 7, the rotation imparted to pulley 86 is coupled through gears 84 and 82 to drive roller 77, which advances the ink ribbon 34. To prevent the ink ribbon 34 from being driven in a reverse direction when the carriage assembly 25 is being returned, drive pulley 86 is rotatably coupled to shaft 85 by means of the one-way clutch assembly 88. This assembly 88, which is shown in detail in FIG. 3*a*, is of conventional construction, comprising a plurality of radially movable pawl members 89 which lock pulley 86 and shaft 85 together only when the carriage assembly 25 is advancing and pulley 86 is being driven in a clockwise direction by carriage drive belt 32. When the carriage assembly 25 is being returned, drive pulley 86 is driven in a counterclockwise direction, and the one-way clutch assembly 88 slips so that gear 84 is not driven and the ribbon 34 remains stationary. Should the teleprinter 10 be adapted to print in a bidirectional mode, an additional transmission assembly may be provided between gear 84 and pulley 86 to reverse the direction of rotational coupling between these elements 84 and 86 when the carriage assembly 25 is operating in a reverse direction so that the ink ribbon 34 will always advance in the same direction.

As shown in FIG. 2, the ends of the carriage drive belt 32 may be conveniently fastened to carriage assembly 25 by wrapping the respective ends of the belt 34 around retainer members 90 and 91 mounted on carriage base plate 45. The belt ends are wrapped around the retainer members 90 and 91 and doubled back to form a closed loop with opposing cogs engaged. Channel portions 92 and 93 of the retaining members 90 and 91 holds the cogs in engagement.

The invention provides a teleprinter of compact and economical construction which requires a minimal number of components. The print head carriage is simple in construction yet provides a reliable positive alignment for the print head with respect to the paper platen. Furthermore, the invention provides a removable automatically advanced ink ribbon cartridge which can be readily removed by the user for replacement and/or repair.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A teleprinter for printing data on a print-receiving surface, comprising, in combination:

a housing;

a print head;

means including a carriage slidably mounted within said housing for supporting said print head in generally perpendicular alignment to said print-receiving surface, said carriage being constrained to slide along a predetermined operating path parallel-spaced from said print receiving surface;

carriage drive means comprising first and second pulleys arranged at either end of said carriage operating path in a common plane generally parallel to said operating path;

a flexible carriage drive belt passing over said pulleys and forming therebetween a first span and a second span, said belt being fixedly engaged to said carriage along said first span thereof;

means for rotatably driving at least one of said pulleys whereby said carriage is moved along said operating path with movement of said carriage drive belt over said pulleys;

means including an ink ribbon carried on said carriage and positioned between said print head and said print-receiving surface for producing in cooperation with said print head a visible image on said print-receiving surface, said ribbon requiring periodic advancement upon operation of said print head to avoid depletion of the ink contained thereon; and ribbon drive means carried on said carriage for mechanically engaging said second span of said carriage drive belt intermediate said first and second pulleys to advance said ink ribbon during movement of said carriage along said operating path.

2. A teleprinter as defined in claim 1 wherein said ribbon drive means comprise a third pulley operatively engaged to said second span of said drive belt.

3. A teleprinter as defined in claim 1 wherein said ribbon drive means include a ribbon drive wheel operatively engaged with said ink ribbon for advancing said ribbon with rotation of said drive wheel, and a third pulley for engaging said second span of said flexible drive belt, and coupling means for rotatably coupling said ribbon drive wheel to said third pulley whereby said drive wheel is rotatably driven with movement of said carriage along said operating path.

4. A teleprinter as defined in claim 3 wherein said coupling means comprise a one-way clutch whereby said ribbon is advanced with movement of said carriage along said operating path in one direction only.

5. A teleprinter as defined in claim 1 wherein said ink ribbon is contained within a cartridge assembly removably mounted on said carriage.

6. A teleprinter as defined in claim 5 wherein said ribbon is in the form of a continuous loop within said cartridge.

7. A teleprinter as defined in claim 1 wherein said flexible carriage drive belt comprises a single one-piece belt having the ends thereof attached along said first span to said carriage.

8. A teleprinter for printing data on a print-receiving surface, comprising, in combination:

a housing;

a print head;

means including a carriage for supporting said print head in generally perpendicular alignment to said print-receiving surface, said carriage being constrained to slide along a predetermined operating path parallel-spaced from said print-receiving surface;

carriage drive means comprising first and second pulleys arranged at either end of said carriage operating path in a common plane generally parallel to said operating path;

a flexible carriage drive belt passing over said pulleys and forming therebetween a first span and a second span, said belt being fixedly engaged to said carriage along said first span thereof;

means for rotatably driving at least one of said pulleys whereby said carriage is moved along said operating path with movement of said carriage drive belt over said pulleys;

means including an ink ribbon carried on said carriage and positioned between said print head and said print-receiving surface for producing in cooperation with said print head a visible image on said print-receiving surface, said ribbon requiring periodic advancement upon operation of said print head to avoid depletion of the ink contained thereon; and ribbon drive means carried on said carriage comprising a ribbon drive wheel operatively engaged to said ink ribbon for advancing said ink ribbon upon rotation thereof, and a third pulley operatively engaging said second span of said carriage drive belt intermediate said first and second pulleys and rotatably coupled to said ribbon drive wheel for advancing said ink ribbon during movement of said carriage along said operating path.

9. A teleprinter as defined in claim 8 wherein said ribbon drive means comprise a one-way clutch assembly for rotatably coupling said third pulley to said ribbon drive wheel whereby said ribbon is advanced only with forward motion of said carriage along said operating path.

10. A teleprinter as defined in claim 9 wherein said ink ribbon is contained within a cartridge assembly removably mounted on said carriage and said ribbon drive wheel is detachably coupled to said third pulley.

11. A teleprinter as defined in claim 9 wherein said carriage drive belt comprises a single one-piece belt having the ends thereof attached along said first span to said carriage.

12. A teleprinter as defined in claim 9 wherein said carriage drive belt comprises a cogged belt, and wherein at least said third pulley is complimentarily cogged on the belt engaging surface thereof to engage said carriage drive belt.

* * * * *